US005177881A

United States Patent [19]

Moore

[11] Patent Number: 5,177,881

[45] Date of Patent: Jan. 12, 1993

[54] GOLF ACCESSORY FOR USE WITH A GOLF BAG FOR DRYING A GOLF GLOVE AND DISPLAYING THE LOGO OF A GOLF COURSE OR EVENT

[75] Inventor: Joseph A. Moore, Atlanta, Ga.

[73] Assignee: Hang 5, Inc., Atlanta, Ga.

[21] Appl. No.: 642,449

[22] Filed: Jan. 17, 1991

Related U.S. Application Data

[63] Continuation-in-part of Ser. No. 418,278, Oct. 6, 1989, abandoned, and a continuation-in-part of Ser. No. 502,025, Mar. 30, 1990.

[51] Int. Cl.[5] ..... F25B 25/00; A63B 55/00

[52] U.S. Cl. ..... 34/239; 34/243 R; 206/315.3

[58] Field of Search ..... 34/243 R, 239, 42; 206/315.2, 315.3, 315.4, 315.5, 315.7, 315.8; D21/234

[56] References Cited

U.S. PATENT DOCUMENTS

| | | |
|---|---|---|
| 3,128,812 | 4/1964 | Scheurer . |
| 3,585,693 | 4/1969 | Barnhardt . |
| 3,638,284 | 1/1972 | Baker . |
| 4,209,913 | 7/1980 | Wallin et al. . |
| 4,625,862 | 12/1986 | Clayton . |
| 4,689,897 | 9/1987 | Marsalona . |
| 4,796,789 | 1/1989 | Willcocks . |

*Primary Examiner*—Henry A. Bennet

[57] ABSTRACT

A golfing accessory capable of being attached to the exterior of a golf bag includes a plate-like portion providing space for the name of the golfer and the logo of a particular golf course or golfing event. The plate-like element is attached to a first strap attached to the bag. A second strap hangs from the plate-like portion and contains a fastener thereon for detachably securing a golf glove for the purpose of drying the glove. A hook may also be provided on the first strap for hanging a golfing towel.

4 Claims, 2 Drawing Sheets

GOLF ACCESSORY FOR USE WITH A GOLF BAG FOR DRYING A GOLF GLOVE AND DISPLAYING THE LOGO OF A GOLF COURSE OR EVENT

BACKGROUND OF THE INVENTION

This application is a continuation-in-part of U.S. application Ser. No. 07/418,278 filed Oct. 6, 1989 now abandoned and U.S. Ser. No. 07/502,025 filed Mar. 30, 1990, both by Joseph A. Moore.

The present invention relates to a golfing accessory capable of being attached to a golf bag for identifying the user of the golf bag and/or a golf course or event, and for hanging golf glove thereon for drying.

Heretofore "bag tags" have been in common use for attachment to golf bags to place the name of the user or owner of the golf bag thereon for identification purposes. These "bag tags" have been designed for this single purpose and are quite standard and unimaginative in their construction.

It has also been known to provide an apparatus attachable to a golf bag for supporting a golf glove in a hanging position from the exterior of the golf bag in order to effect drying of the glove between the various holes of golf. These golf glove drying devices have also been single purpose devices and often have consisted of rather complex forms or frames about which the golf glove is placed and have lacked the simplicity of construction and low cost required to make them practical additions to a golfers supply of accessories.

SUMMARY OF THE INVENTION

Accordingly, it is a primary object of the present invention to provide a better "bag tag" for use on a golf bag which will also attractively display the logo of a golf course or a golfing event in combination with a simplistic means for hanging a golfers glove to dry from the outside of the golf bag in a simple and efficient manner.

It is a further object of the present invention to provide a much better and attractive "bag tag" than known heretofore.

It is another object of the present invention to provide a more simplistic and inexpensive glove drying apparatus for attachment to a golf bag.

It is still a further object of the present invention to provide a combined "bag tag" and glove drying apparatus which further includes a fastener for hanging a golfing towel therefrom.

These and other objects of the present invention are fulfilled by providing a golfing apparatus capable of being attached to a golf bag for identifying the user of the golf bag and/or a golf course or event, and for hanging a golf glove thereon for drying comprising a first strap having first and second distal ends; a first fastener connected to the first distal end of the first strap for detachably securing it to a golf bag; a plate-like element having first and second major surfaces capable of containing printed matter thereon for identifying the user of the golf bag and/or a golf course or event, said plate-like element being connected to the second distal end of said first strap; a second strap connected to the plate-like element to hang therefrom; and fastener means on said second strap for detachably supporting a golf glove thereon to thereby permit the glove to dry while hanging from the outside of the golf bag.

In a preferred embodiment the fastener means is a Velcro strip which engages a like Velcro strip on the wristband portion of the golf glove. This Velcro strip is a very inexpensive yet efficient fastener since it takes advantage of the existence of a like Velcro strip on the wristband portion of the golf glove.

The plate-like element for displaying the golfer's name and/or logo of a golf club or event can be any suitable shape such as a circular shape or a rectangular shape.

The structure of the golfing accessory of the present invention combines the functions of "bag tags" and a golf glove drying arrangement into a single uniquely arranged structure which performs all of the standard functions of "bag tags" and golf glove drying devices but in a better and enhanced way.

The golfing accessory of the present invention is a unique novelty item which can be purchased as a souvenir or gift. Furthermore, it is a better "bag tag" then previously known; a better glove drying device; and includes the additional capability of hanging a golfing towel thereon resulting in an attractive unique and highly functional device.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The present invention will become more fully understood from the detailed description given hereinbelow and the accompanying drawings which are given by way of illustration only, and thus, are not limitative of the present invention and wherein:

DESCRIPTION OF PREFERRED EMBODIMENTS

Figure 1:
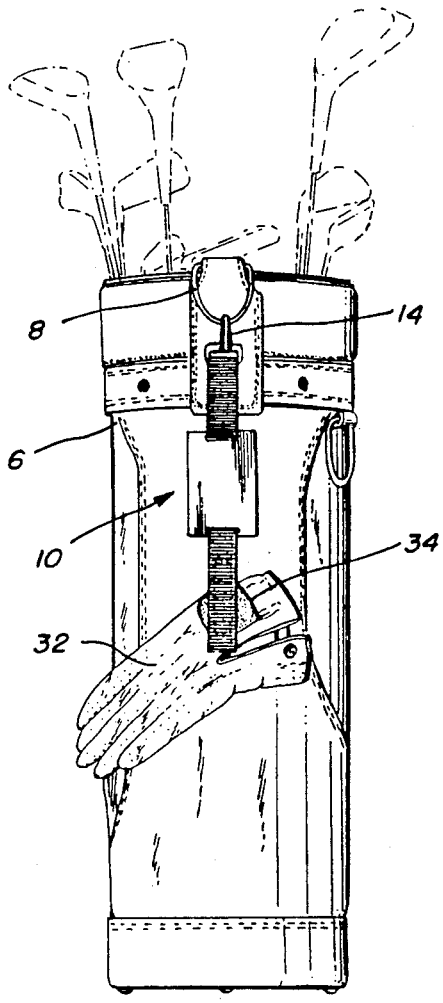
FIG. 1 is a front elevational view of a golf bag with the golfing accessory of the present invention hanging from a standard bag ring.
Figure 2:
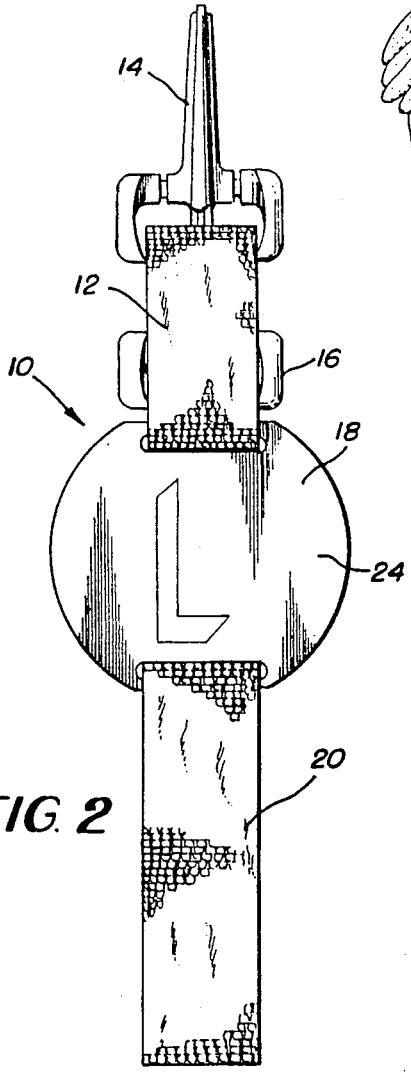
FIG. 2 is a front elevational view of the golfing accessory of the present invention.

Referring to the figures of the drawings there is illustrated the golfing accessory 10 of the present invention in FIG. 1 hanging from a golf bag 6 and specifically a bag ring 8 thereon. Hanging from the golfing accessory 10 and more specifically from a hook 16 is a golfer's towel 30 and a golfer's glove 32. The golfer's glove 32 has a standard Velcro patch 34 thereon at the wristband portion for tightening about the user's wrist as is standard for most golf gloves on the market today.

Figure 3:
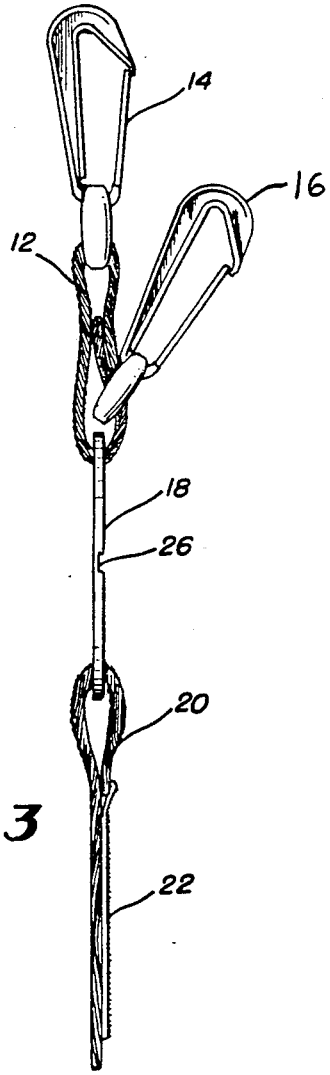
FIG. 3 is a side elevational view of the golfing accessory of FIG. 2.

The operation of the golf accessory 10 of the present invention will become better understood with reference to the detailed structure thereof as illustrated in FIGS. 2–5. The golfing accessory 10 includes a first strap portion 12 preferably formed of nylon webbing looped through a ring in a hook 14 which is attachable to the bag ring 8 of FIG. 1. A second hook 16 may be provided on strap 12 for the purposes of hanging a golfer's towel, as illustrated in FIG. 3, therefrom.

Figure 5:
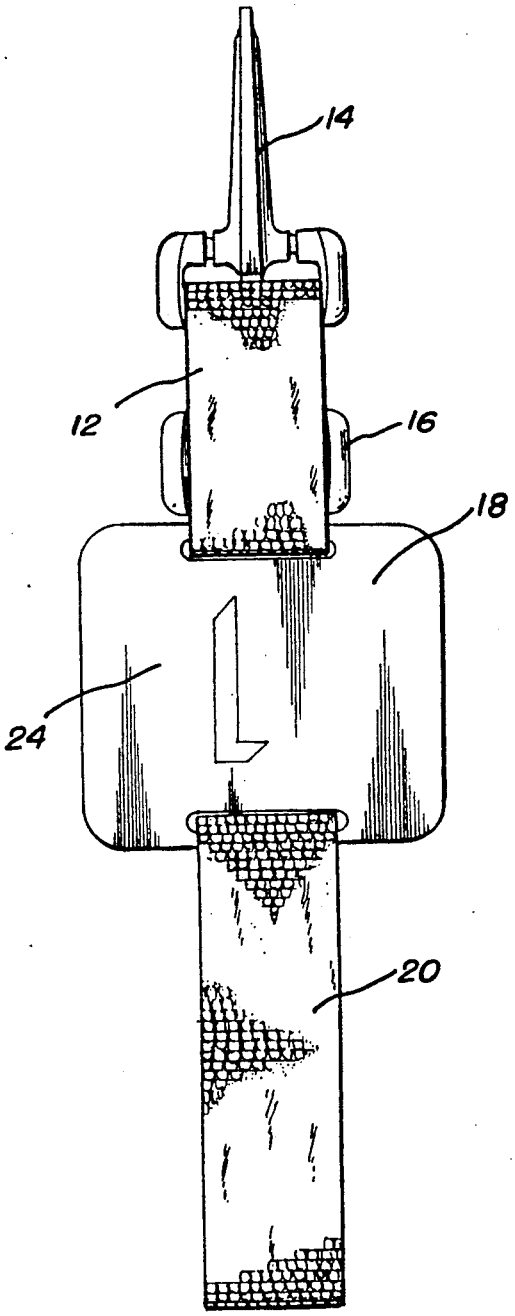
FIG. 5 is a second embodiment of the golfing accessory of the present invention.

An enlarged plate-like element 18 is provided and is preferably fabricated from plastic. It may have either a circular shape as illustrated in FIG. 1 or a rectangular shape as illustrated in FIG. 5. However, any other shape may be utilized without departing from the spirit and scope of the present invention. The front face or obverse surface of the plate-like element 18 preferably contains a logo 24 thereon to identify a particular golf club or a special golfing event at which the accessory of the present invention might be handed out as a favor. On the rear face of the plate-like element 18 there is provided a shallow groove 26 into which a standard name tape may be placed such as is conventional practice on "bag tags" per se.

Figure 4:
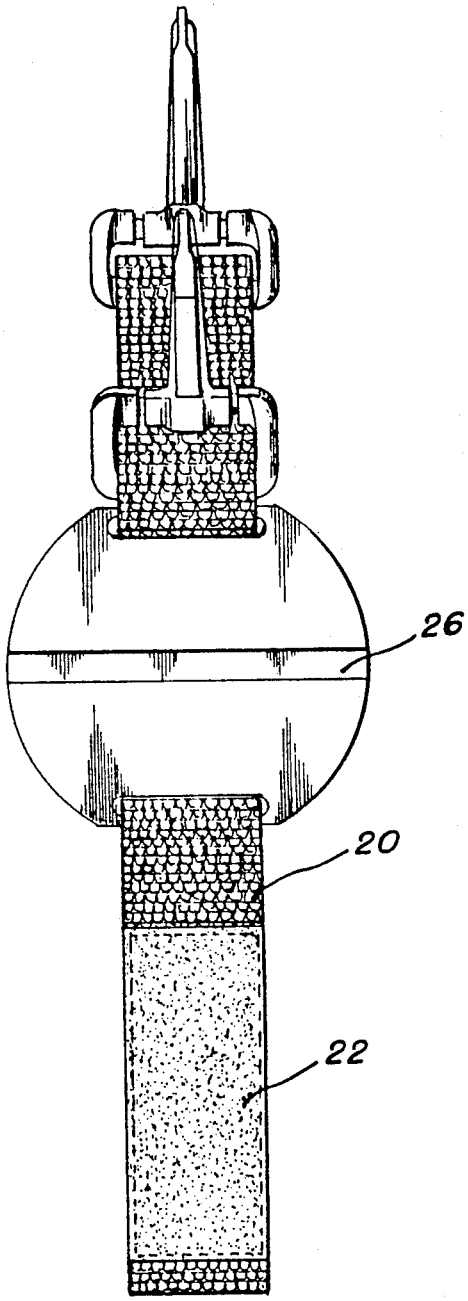
FIG. 4 is a rear elevational view of the golfing accessory of FIG. 2.

The back side of strap portion 20 as illustrated in FIG. 4 is provided with a Velcro strip 22 which mates with the Velcro 34 on the wristband portion of the glove 32 as illustrated in FIG. 1.

Accordingly, the golfing accessory of the present invention provides a unique structure which attaches to a standard ring on a golf bag and provides a place for prominently displaying the logo of the golf club or special event for countless rounds of golf. Furthermore, the bottom webbing or strap, which hangs from the plate-like portion displaying the logo, has a Velcro strip for attaching a golfer's glove which allows for natural drying and shape retention of the golf glove during a round of golf.

The accessory of the present invention provides an ideal premium for corporate golf outings, an attractive and useful favor for Pro-Am or member guest golf tournaments, and a unique souvenir or gift for sale in golf shops throughout the world.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A golfing apparatus capable of being attached to a golf bag for identifying the user of the golf bag and/or a golf course or event, and for hanging a golf glove thereon for drying comprising:

a first strap having first and second distal ends;

a first fastener connected to the first distal end of the first strap for detachably securing it to a golf bag;

a second fastener connected to said first strap for detachably securing a towel thereto a plate-like element having first and second major surfaces capable of containing printed matter thereon for identifying the user of the golf bag and/or a golf course or event, said plate-like element being connected to the second distal end of said first strap;

a second strap connected to the plate-like element to hang therefrom; and fastener means on said second strap for detachably supporting a golf glove thereon to thereby permit the glove to dry.

2. The golfing apparatus of claim 1 wherein said fastener means is a Velcro strip which engages a like Velcro strip on the golf glove.

3. The golfing apparatus of claim 1 wherein said plate-like element is rectangular.

4. The golfing apparatus of claim 1 wherein said plate-like element is circular.

* * * * *